US007116280B2

(12) United States Patent
Bohlman

(10) Patent No.: US 7,116,280 B2
(45) Date of Patent: Oct. 3, 2006

(54) HIGH POWER POSITIONAL FIXTURE FOR A MULTI-POLARIZED ANTENNA

(75) Inventor: Walter A Bohlman, Quakertown, PA (US)

(73) Assignee: BAE Systems Information and Electronic Systems Integration INC, Nashua, NH (US)

( * ) Notice: Subject to any disclaimer, the term of this patent is extended or adjusted under 35 U.S.C. 154(b) by 183 days.

(21) Appl. No.: 10/986,965

(22) Filed: Nov. 12, 2004

(65) Prior Publication Data

US 2006/0103582 A1 May 18, 2006

(51) Int. Cl.
*H01Q 3/06* (2006.01)

(52) U.S. Cl. ..... 343/763; 343/766; 343/905

(58) Field of Classification Search ..... 343/762, 343/763, 765, 905

See application file for complete search history.

(56) References Cited

U.S. PATENT DOCUMENTS 4,028,708 A 6/1977 Woodward
5,432,524 A * 7/1995 Sydor ..... 343/765
5,485,169 A * 1/1996 Kitabatake et al. ..... 343/765
5,508,712 A 4/1996 Tom et al.
5,708,447 A 1/1998 Kammer et al.
6,188,367 B1 * 2/2001 Morrison et al. ..... 343/765
6,685,383 B1 2/2004 Rosenfeld

* cited by examiner

*Primary Examiner*—Michael C. Wimer
(74) *Attorney, Agent, or Firm*—Maine & Asmus

(57) ABSTRACT

A compact fixturing means is disclosed that delivers two or more phase tracked channels of high power (e.g., 1000 Watts) to an antenna that can produce a multiplicity of polarization depending on the phase relationship of the delivered signals. Coaxial cables are used as a service loop to provide two or more channels of phase tracking and high power signals to the multi-polarized antenna. A flat spiral spring is configured within the fixture to the guide two (or more) coaxial cables along a spiral loop to allow approximately equal tension on the cables as the fixture is rotated. The flat spiral spring is operatively coupled to a rotation plate and progresses form an inner radius proximate the fixture input to an outer radius proximate the fixture output.

20 Claims, 3 Drawing Sheets

HIGH POWER POSITIONAL FIXTURE FOR A MULTI-POLARIZED ANTENNA

FIELD OF THE INVENTION

The invention relates to antennas, and more particularly, to a high power positional fixture for a multi-polarized antenna.

BACKGROUND OF THE INVENTION

Transmitting antennas have many purposes ranging from simple communication from one point to another to the tracking of objects (e.g., vehicles, ships, aircraft) to the jamming of remote communication systems. The power, frequency, and polarization of the signals transmitted depend on the particular application and the antenna configuration. For example, jamming involves the transmission of high power random signals to impair an unfriendly radar's operation (e.g., by saturating its receiver or obscuring target echoes on its display). The disruptive jamming signals are through the entire frequency band used by the unfriendly radar.

A conventional jammer configuration includes a broadband dual polarized diagonal horn that covers an entire frequency band of interest, and two full band transmitters space combined to produce vertical, horizontal, or circular polarization. The phase shift to control the particular polarization is performed by the backend circuit of the antenna system, as is known.

One problem associated with such dual polarized antennas is that they typically require a dual channel rotary joint to provide continuous rotating performance. Dual channel rotary joints are physically large. In addition, they typically have a shunt stub in one channel that limits the low VSWR bandwidth and power, and also prohibits phase tracking.

What is needed, therefore, is a high power positional fixture configuration for a multi-polarized antenna.

SUMMARY OF THE INVENTION

One embodiment of the present invention provides a high power positional fixture for a multi-polarized antenna. The fixture includes a rotation plate having a top side and a bottom side. A flat spiral spring is operatively coupled to the bottom side of the rotation plate, and is configured with one or more turns progressing form an outer radius to an inner radius. Two or more coax cables are each loosely coupled to a path substantially defined by the flat spiral spring, thereby enabling delivery of two or more phase tracked channels of high power to a multi-polarized antenna operatively coupled to the fixture. The fixture may further include a positional motor operatively coupled between a stationary plate and the bottom side of the rotation plate. The motor is configured for rotating the rotation plate through a range of rotation (e.g., +/−200 degrees). The fixture may further include a feed circuit and amplifier for providing phase tracking and high power signals to the multi-polarized antenna via the two or more coax cables. Note that the amplifier can be configured to provide two or more high power channels (one channel for each cable). The fixture may further include the multi-polarized antenna (e.g., horn), which can be fastened to the top side of the rotation plate, and the two or more coax cables are operatively coupled to the antenna. The flat spiral spring can be configured with a plurality of sleeves adapted for loosely securing the two or more coax cables to the flat spiral spring. The fixture may further include a low friction mechanism (e.g., bearing race between the stationary plate and the bottom side of the rotating plate) that is adapted to facilitate rotation of the rotation plate. The fixture can be fabricated to be compact in form, and in one particular embodiment is three inches or less in height.

Another embodiment of the present invention provides a high power multi-polarized antenna system. The system includes a stationary plate, and a rotation plate having a top side and a bottom side. A multi-polarized antenna (e.g., horn) is fastened to the top side of the rotation plate. A positional motor is operatively coupled between the stationary plate and the bottom side of the rotation plate, and is configured for rotating the rotation plate through a range of rotation (e.g., +/−200 degrees). A flat spiral spring is operatively coupled to the bottom side of the rotation plate and configured with one or more turns progressing form an outer radius to an inner radius. A feed circuit and amplifier provides phase tracking and high power signals. Two or more coax cables are each loosely coupled to a path substantially defined by the flat spiral spring, for delivering the phase tracking and high power signals from the feed circuit and amplifier to the multi-polarized antenna. Note that the amplifier can be configured to provide two or more high power channels (one channel for each cable). The flat spiral spring can be configured with a plurality of sleeves that are adapted for loosely securing the two or more coax cables to the flat spiral spring. The system may further include a low friction mechanism adapted to facilitate rotation of the rotation plate. Note that the stationary and rotation plates, the multi-polarized antenna, the positional motor, the flat spiral spring, the feed circuit and amplifier, and the two or more coax cables can be used to provide a first jamming transmitter. Here, the system may further include a second such jamming transmitter, thereby providing a pod capable of jamming two separate threats.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION OF THE INVENTION

Embodiments of the present invention provide a compact fixturing means to deliver two or more phase tracked channels of high power (e.g., 1000 Watts) to an antenna that can produce a multiplicity of polarization depending on the phase relationship of the delivered signals.

Figure 1A:
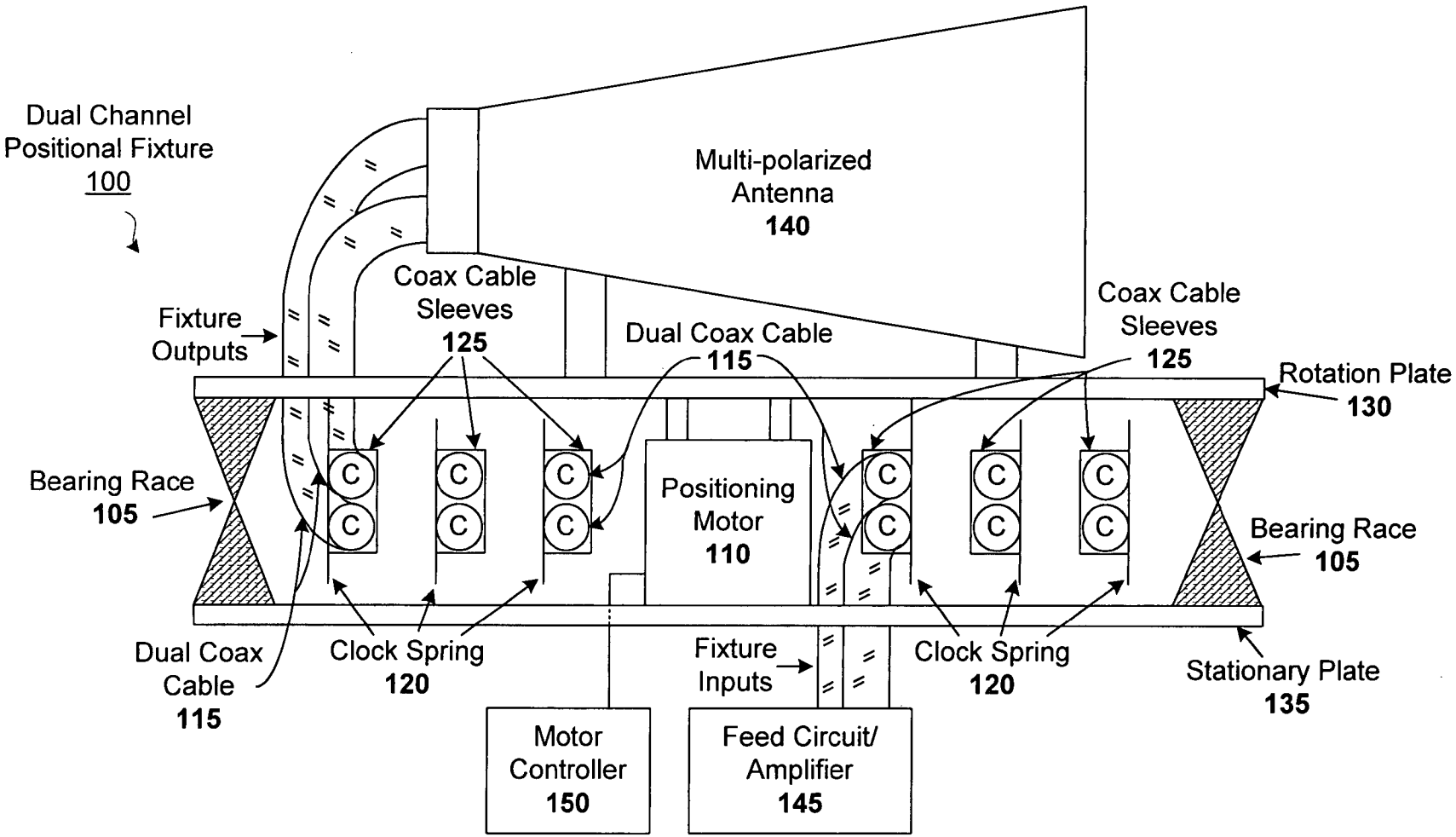
FIG. 1*a* shows a cross-section view of a dual channel positional fixture for a multi-polarized antenna configured in accordance with one embodiment of the present invention.

FIG. 1*a* shows a cross-section view of a dual channel positional fixture for a multi-polarized antenna configured in accordance with one embodiment of the present invention. As can be seen, the fixture 100 includes a bearing race 105, a positioning motor 110, a dual coaxial cable 115, a clock spring, a number of cable sleeves 125, a rotation plate 130, and a stationary plate 135. A multi-polarized antenna 140 is secured to the rotation plate 130, and is fed from one end of the dual coaxial cable 115 that extends perpendicularly through the rotation plate 130. The other end of the dual coaxial cable 115 extends perpendicularly through the stationary plate 135 and is coupled to a feed circuit/amplifier 145. A motor controller 150 is operatively coupled to the positioning motor 110.

At the center of the fixture 100 is the positioning motor 110, which can be implemented with, for example, a conventional stepper motor or other suitable positioning mechanism (e.g., servo controlled motor). Positioning information is provided to the motor 110 by the motor controller 150, which can be programmed either locally or remotely via wired or wireless input, so as to allow real-time control of the antenna 140 position. In one particular embodiment, the motor 110 is capable of rotating +/−200 degrees, thereby providing a full range of rotation suitable for most operational scenarios. The motor is selected so that it is capable of efficiently moving the overall weight of the fixture 100, including the antenna 140. The base or housing of the motor 110 is coupled to a stationary plate 135, and the drive mechanism or actuator of the motor 110 is coupled to the rotation plate 130. Thus, the motor 110 can move the rotation plate through a range of rotation (in both directions about the axis of rotation). The rotation plate 130 and the stationary plate 135 can be fabricated from, for example, a metal (e.g., aluminum, steel, or titanium) or a rigid plastic (e.g., ABS, nylon, or polycarbonate).

During rotation, the rotation plate 130 remains substantially parallel to the stationary plate 135 via the use of the bearing race 105. The bearing race 105 can be implemented with a conventional bearing that has its housing fixed to the perimeter of the stationary plate 135 and its bearings portion configured to facilitate rotation of the rotation plate 130. Note that the bearing race 105 could also be a ring of steel fastened to the perimeter of the stationary plate 135 by it first side, where it other side is machined to provide a narrow, smooth surface that the rotation plate 130 could glide along. Graphite or the like could be used to reduce friction between the plate 130 and the race 105, thereby reducing drag on the motor 110. Other such configurations to distribute forces evenly and provide ease of rotation can be used here as well.

The dual coaxial cable 115 is used as a service loop to provide two channels of phase tracking and high power signals to the multi-polarized antenna 140, which in this case is a horn. The spring 120 is configured and attached to allow approximately equal tension on the cables 115 as the fixture 100 is rotated. Numerous configurations will be apparent in light of this disclosure.

Spring and Dual Coax Cable Assembly

In the example configuration shown, the dual coaxial cable 115 is formed into a three loop spiral, and can be implemented using two off-the-shelf conventional coaxial cables having a common length. Note that the two coaxial cables can be custom built if so desired, and can also be jacketed together to form the dual coaxial cable 115. In any case, the specifications of the cable 115, such as frequency range, power rating, conductor type, and dielectric strength should be selected based on the particular requirements of the given application.

In order to prevent the dual coaxial cable 115 from becoming unruly and departing from its spiral loop shape as the fixture 100 is rotated, the multi-turn clock spring 120 is used. In general, the clock spring 120 has the same number of turns (or more) than the number of turns in the service loop formed by the dual coaxial cable 115. The dual coaxial cable 115 is loosely secured to the clock spring 120 at periodic points along the spring 120, so that the cables effectively track the spring. In this sense, the spring 120 effectively defines the path that the cable 115 will follow as it spirals through the fixture to form the service loop from the feed circuit/amplifier circuit 145 to the multi-polarized antenna 140.

Figure 1B:
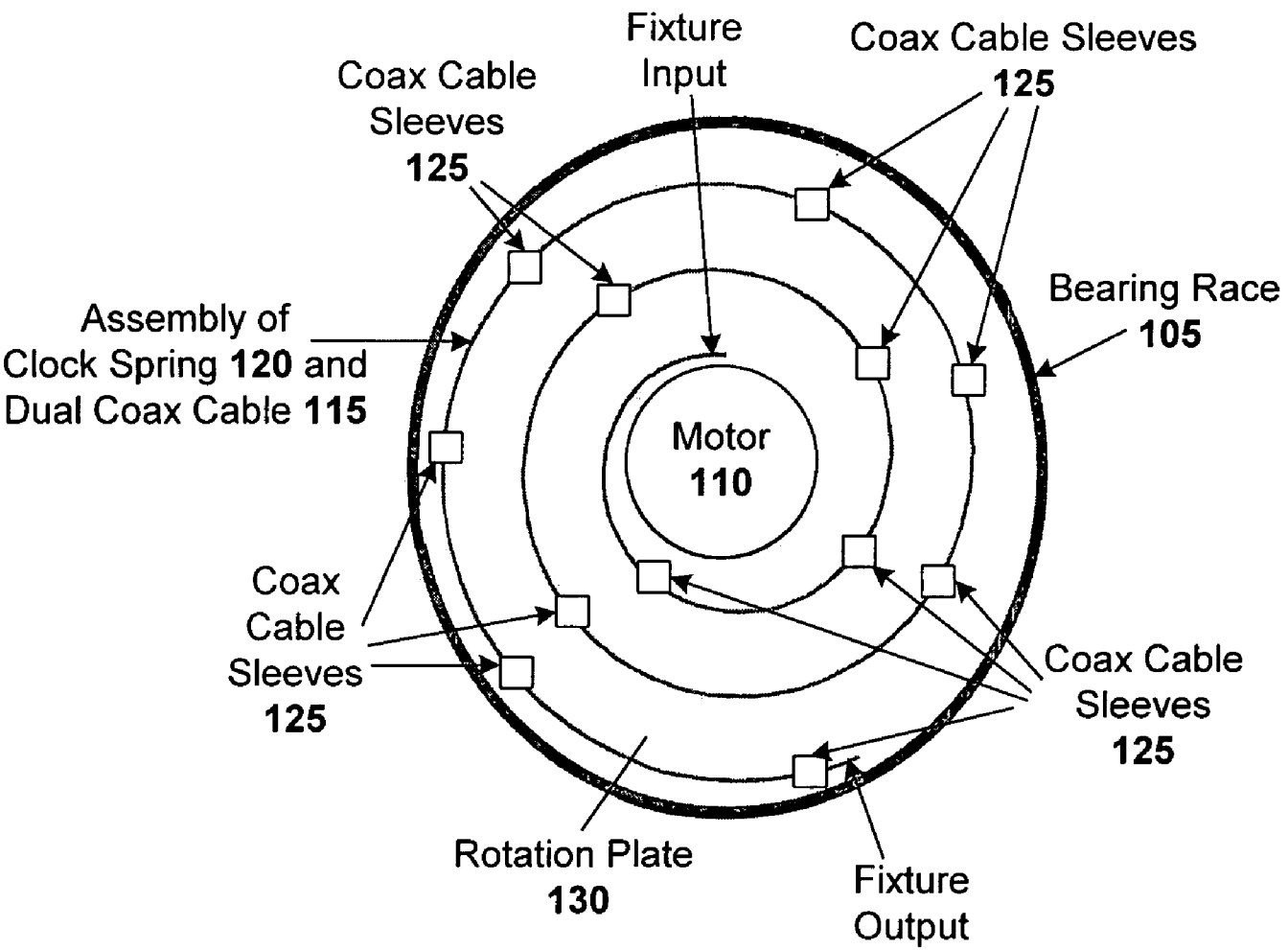
FIG. 1*b* shows a top view of a dual coax cable formed into a spiral service loop using a clock spring configured with sleeves to guide the cable along the spring, in accordance with one embodiment of the present invention.

In the example configuration shown in FIGS. 1*a* and 1*b*, the clock spring 120 is configured with a number of coax cable sleeves 125 that loosely hold the cables 115 in place along the spring 120. The fixture input from the feed circuit/amplifier 145 is provided proximate the motor 110, by passing the dual coax cable 115 perpendicularly through the stationary plate 135. Note that the amplifier can be configured to provide two high power channels (one channel for each cable making up dual coax cable 115). Alternatively, two separate amplifiers can be provided. The dual coax cable 115 (shown in cross-section, with each of the two cables designated as a "C" in a circle in FIG. 1*a*) then travels loosely along the length of the clock spring 120 (also shown in cross-section as a vertical line in FIG. 1*a*) and passes through each sleeve 125 of the spring 120. The cable 115 then passes perpendicularly through near the perimeter of the rotation plate 130, allowing room for the race bearing 105 as shown.

The clock spring 120 can be implemented, for example, with a thin band spring steel formed into a flat spiral shaped mechanical spring (other flexible spring material can be used here as well). The spring 120 is secured to the rotation plate 130. For instance, both ends of the clock spring 120 can be welded to corresponding locations on the rotation plate 130 as shown in FIG. 1*a*, assuming the rotation plate is weldable. The clock spring 120 can be guided by pins attached to the rotation plate 130 at intermediate points. Note that any suitable bonding technique can be used here to secure the spring 120, depending on the materials used to fabricate the fixture 100. For instance, non-weldable plastic components could be coupled using an epoxy. In general, the materials used to fabricate the fixture 100 (including bonding techniques and materials) must be sufficiently robust to ensure the mechanical integrity of the fixture 100, giving application particulars such as the weight of antenna 140, range of fixture rotation, and the speed and torque ratings of motor 110.

While FIG. 1*a* shows a cross-section view of the fixture 100, FIG. 1*b* shows a top view, with the rotation plate 130 removed for purposes of illustration. As can be seen in FIG. 1*b*, the clock spring 120 and the dual coax cable 115 form an assembly that forms a three loop spiral that essentially starts at the fixture input proximate the motor 110 and finishes at the fixture output towards the outer perimeter of the fixture 100. The dimension of the sleeves 125 would allow the cables 115 to loosely passes therethrough, as shown in the cross-sectional view of FIG. 1*a*. The coax cable sleeves 125 of the spring can be, for example, wire loops that are welded, soldered, or otherwise bonded to the flat face of the clock spring 120, spaced evenly so as to provide sufficient coupling between the spring 120 and the cable 115.

Note that the fixed portion of the cable 115 at the fixture input proximate the motor and center of the fixture 100. As such, this part of the cable 115 will not be overly stressed or pulled as the fixture rotates. In addition, an amount of slack can be left in the cable near this input location to allow for unencumbered rotation to the extreme rotation positions in either direction. Thus, as the fixture rotates through its full range of motion (e.g., +/−200 degrees), the fixed portion of the cable 115 has sufficient slack and the remainder of the cable 115 travels loosely along with the spring 120 as the rotation plate 130 rotates in response to motor 110.

The multi-polarized antenna 140 can be implemented with conventional techniques, and may be configured in a number of conventional forms (e.g., horn, waveguide, broadband dipole). The antenna gain will vary from one application to another, but typically will be in the order of 6 dBi at the low end of the band to 16 dBi at the high end of the band. In the embodiment shown, the multi-polarized antenna is a horn. In one such embodiment, the horn can utilize a lens to maximize the high end gain for the given length of the horn.

In one specific embodiment, the size of the fixture 100 is about 16 inches in diameter and about 1 inch high. Each of the two cables 115 are about ⅜ of an inch in diameter and are rated for a typical power level of about 1000w. The cables 115 are stacked vertically and loosely attached to the clock spring 120 as explained herein. The assembly of the clock spring 120 and dual coax cable 115 includes a three turn spiral progressing from an extreme outer radius of about 8 inches to an inside radius of about 2.5 inches. In rotating +/−200 degrees, any local area of the cable moves very little and the bend radius of the cable is not approached. In such an embodiment, the rotation plate 130 and the stationary plate 135 are two disks about 16 inches in diameter, where the stationary plate 135 could be mounted to a pod structure while the rotation plate 130 would provide the antenna 140 support. The motor 110 is about 5 inches in diameter and about one inch in height (or less). With such dimensions, the antenna 140 and positional fixture 100 could be contained in a volume 1 Q inch high by 16 inch in diameter, where Q includes the height of the fixture 100 (about 1 inch) and the height of the antenna 140 (which will vary depend on the chosen antenna). The maximum loss at 2.5 GHz is estimated to be in the order of 0.7 dB or less.

Other configurations will be apparent in light of this disclosure, and the present invention is not intended to be limited to any one such configuration. For example, other embodiments may employ a single coax cable, or more than two coax cables, to provide the phase tracking and high power signals to the antenna 140. Also, the assembly of the clock spring 120 and dual coax cable 115 may include any number of turns, ranging from one to N, where N will depend on the desired size of the fixture 100 and other performance parameters, such as operating frequency range and loss. The materials from which the fixture 100 is made will depend on the desired size, weight, and durability, given a known environment in which the fixture 100 will be operating.

Dual Threat Jamming Pod

Figure 2:
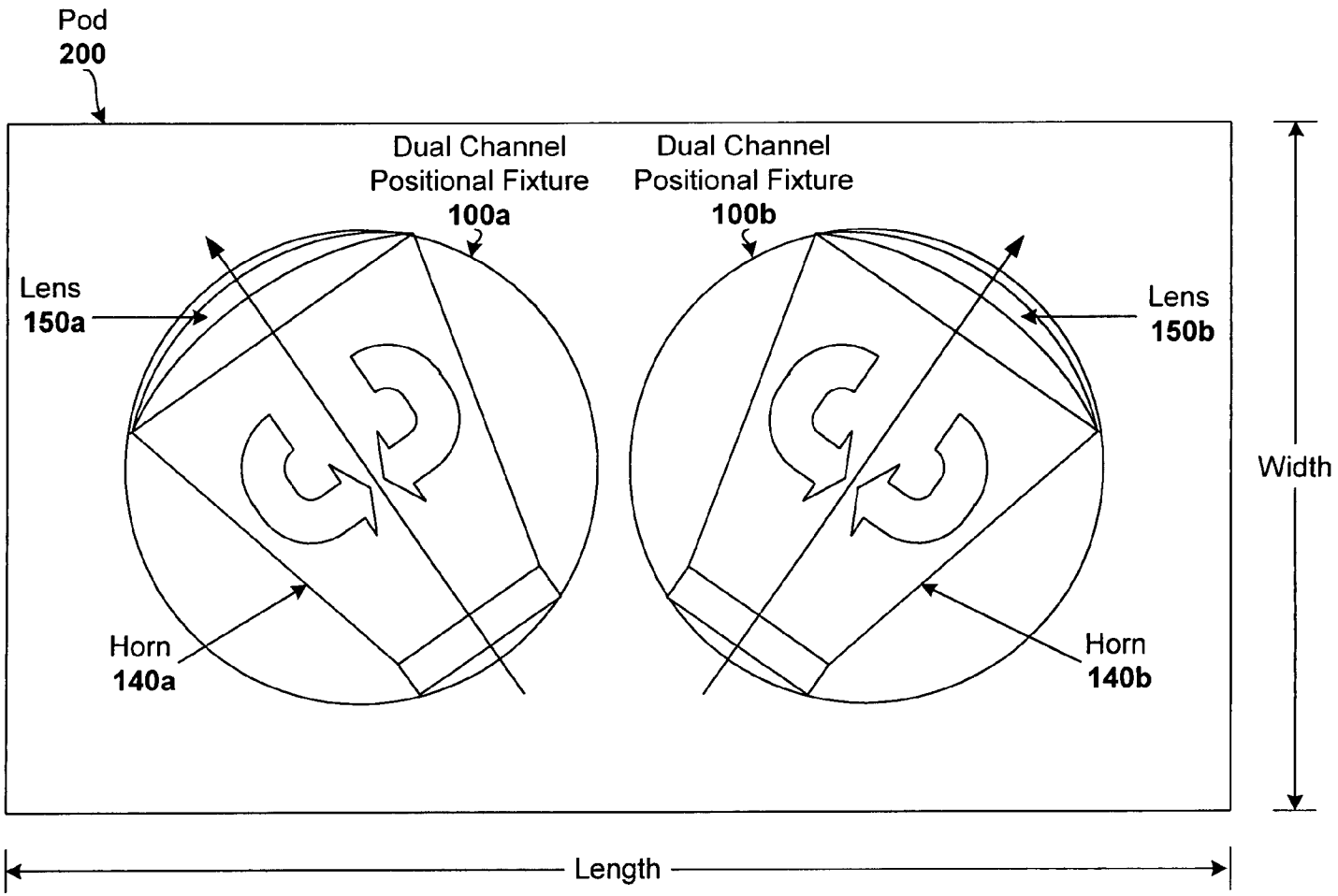
FIG. 2 shows a pod that includes two dual channel positional fixtures and multi-polarized antennas jamming two threats, in accordance with one embodiment of the present invention.

FIG. 2 shows a pod 200 that includes two dual channel positional fixtures 100*a* and 100*b* and their respective multi-polarized antennas 140*a* and 140*b*. Note that each of the fixtures 100*a* and 100*b* can be configured, for example, as discussed in reference to FIGS. 1*a* and 1*b*. The pod 200 is configured for simultaneously jamming two different threats. Here, each of the horns 140*a* and 140*b* is configured with a lens 150*a* and 150*b*, respectively, to maximize the high end gain for the given length of the horn as conventionally done.

Assuming each of the fixtures 100*a* and 100*b* are each about 16 inches in diameter (for example), then the length of the pod 200 would be just over 32 inches, while the width could remain about 16 inches. The height of the fixture is generally less than three inches, and in one particular embodiment, about an inch. The height of the antennas 140*a* and 140*b* will be added to the of their respective fixtures 100*a* and 100*b*, to provide the overall height off the pod 200.

Having two jamming units in one pod 200 permits a large variety of jamming flexibility. The spacing of the units is such that in general they could not be arrayed except in some specially selected coverage angles at the low end of the band.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A high power positional fixture for a multi-polarized antenna, comprising:

a stationary plate;

a rotation plate having a top side and a bottom side;

a positional motor operatively coupled between the stationary plate and the bottom side of the rotation plate, and configured for rotating the rotation plate through a range of rotation;

a flat spiral spring that is operatively coupled to the bottom side of the rotation plate and configured with one or more turns progressing from an outer radius to an inner radius; and a dual coax cable loosely coupled to a path substantially defined by the flat spiral spring, thereby enabling delivery of two phase tracked channels of high power to a multi-polarized antenna operatively coupled to the fixture.

2. The fixture of claim 1 further comprising a feed circuit and amplifier for providing phase tracking and high power signals to the multi-polarized antenna via the dual coax cable.

3. The fixture of claim 1 further comprising the multi-polarized antenna fastened to the top side of the rotation plate, wherein the dual coax cable is operatively coupled to the antenna.

4. The fixture of claim 3 wherein the multi-polarized antenna is a horn.

5. The fixture of claim 1 wherein the flat spiral spring has a plurality of sleeves adapted for loosely securing the dual coax cable to the flat spiral spring.

6. The fixture of claim 1 further comprising a low friction mechanism between the stationary plate and the bottom side of the rotation plate to facilitate rotation of the rotation plate.

7. The fixture of claim 6 wherein the stationary plate, the rotation plate, and the low friction mechanism define a housing of the fixture that is three inches or less in height.

8. A high power positional fixture for a multi-polarized antenna, comprising:

a rotation plate having a top side and a bottom side;

a flat spiral spring that is operatively coupled to the bottom side of the rotation plate and configured with one or more turns progressing from an outer radius to an inner radius; and two or more coax cables each loosely coupled to a path substantially defined by the flat spiral spring, thereby enabling delivery of two or more phase tracked channels of high power to a multi-polarized antenna operatively coupled to the fixture.

9. The fixture of claim 8 further comprising a feed circuit and amplifier for providing phase tracking and high power signals to the multi-polarized antenna via the two or more coax cables.

10. The fixture of claim 8 further comprising the multi-polarized antenna fastened to the top side of the rotation plate, wherein the two or more coax cables are operatively coupled to the antenna.

11. The fixture of claim 8 wherein the flat spiral spring has a plurality of sleeves adapted for loosely securing the two or more coax cables to the flat spiral spring.

12. The fixture of claim 8 further comprising a low friction mechanism adapted to facilitate rotation of the rotation plate.

13. The fixture of claim 8 wherein the fixture is three inches or less in height.

14. The fixture of claim 8 wherein the fixture has a range of rotation of +/−200 degrees.

15. A high power multi-polarized antenna system comprising:

a stationary plate;

a rotation plate having a top side and a bottom side;

a multi-polarized antenna fastened to the top side of the rotation plate;

a positional motor operatively coupled between the stationary plate and the bottom side of the rotation plate, and configured for rotating the rotation plate through a range of rotation;

a flat spiral spring that is operatively coupled to the bottom side of the rotation plate and configured with one or more turns progressing from an outer radius to an inner radius;

a feed circuit and amplifier for providing phase tracking and high power signals; and two or more coax cables each loosely coupled to a path substantially defined by the flat spiral spring, for delivering the phase tracking and high power signals from the feed circuit and amplifier to the multi-polarized antenna.

16. The system of claim 15 wherein the flat spiral spring has a plurality of sleeves adapted for loosely securing the two or more coax cables to the flat spiral spring.

17. The system of claim 15 further comprising a low friction mechanism adapted to facilitate rotation of the rotation plate.

18. The system of claim 15 wherein the stationary plate, the rotation plate, the multi-polarized antenna, the positional motor, the flat spiral spring, the feed circuit and amplifier, and the two or more coax cables form a first jamming transmitter, the system further comprising a second jamming transmitter, thereby providing a pod capable of simultaneously jamming two separate threats.

19. The system of claim 15 wherein the range of rotation is about +/−200 degrees.

20. The system of claim 15 wherein the multi-polarized antenna is a horn.

* * * * *